US006295975B1

(12) United States Patent
Yew et al.

(10) Patent No.: US 6,295,975 B1
(45) Date of Patent: Oct. 2, 2001

(54) DOUBLE ACTION SINGLE VALVE EEGR

(75) Inventors: Kwang Yew; John Edward Cook, both of Chatham (CA)

(73) Assignee: Siemens Canada Limited, Mississauga (CA)

( * ) Notice: Subject to any disclaimer, the term of this patent is extended or adjusted under 35 U.S.C. 154(b) by 0 days.

(21) Appl. No.: 09/418,069

(22) Filed: Oct. 14, 1999

(51) Int. Cl.[7] ..... F02M 25/07
(52) U.S. Cl. ..... 123/568.2; 251/333; 251/129.15
(58) Field of Search ..... 123/568.2, 568.21, 123/568.26, 568.27; 251/333, 334, 129.15; 137/599.16, 907

(56) References Cited

U.S. PATENT DOCUMENTS 5,042,448 * 8/1991 Cook et al. ..... 137/599.2
5,070,838 * 12/1991 Mckay ..... 123/568.26
5,443,241 * 8/1995 Odaira et al. ..... 251/129.07
5,848,608 * 12/1998 Ishigaki ..... 123/599.2
6,006,733 * 12/1999 Oleksiewicz ..... 123/568.21
6,041,764 * 3/2000 Nemoto et al. ..... 123/568.2
6,047,690 * 4/2000 Field et al. ..... 123/568.26

* cited by examiner

*Primary Examiner*—Andrew M. Dolinar
*Assistant Examiner*—Arnold Castro

(57) ABSTRACT

An EGR valve has two coaxial valve rings that are sequentially opened when the EGR valve is operated. A first, smaller gap is formed by the first valve ring opening and a second larger gap is formed when the first valve ring moves with respect to the second valve ring. In this manner, a nonlinear flow rate is provided through the EGR valve that permits greater accuracy of control at lower exhaust gas flow rates.

13 Claims, 5 Drawing Sheets

DOUBLE ACTION SINGLE VALVE EEGR

FIELD OF THE INVENTION

This invention relates to exhaust gas recirculation (EGR) valves for internal combustion engines, and is particularly directed to a new and improved construction for improving the accuracy and response of the valve to electrical control signals. More particularly, it is directed to a double acting single valve EEGR.

BACKGROUND OF THE INVENTION

Controlled engine exhaust gas recirculation is a commonly-used technique for reducing oxides of nitrogen in products of combustion that are exhausted from an internal combustion engine to the atmosphere. A typical EGR system comprises an EGR valve connected either to the exhaust manifold or the intake manifold that is controlled in accordance with engine operating conditions to regulate the amount of engine exhaust gas that is recirculated to the induction air flow entering the engine for combustion so as to limit the combustion temperature and hence reduce the formation of oxides of nitrogen.

Since they are typically engine-mounted, EGR valves are subject to a harsh operating environment that includes wide temperature extremes and vibrations. Exhaust emission requirements impose more stringent demands for improved control of such valves. Use of an electric actuator is one means for obtaining improved control, but in order to be commercially successful, such an actuator must be able to operate properly in such extreme environments for an extended period of time. Moreover, in mass-production automobile vehicle applications, component cost-effectiveness is also essential. An EGR valve electric actuator that possesses more accurate and quicker response results in improved driveability and fuel economy for a vehicle having an internal combustion engine that is equipped with an EGR system. It also provides better control over tail pipe emissions.

One problem with the EGR valves is their ability to accurately control the amount of exhaust gas flow over a wide range of operating conditions. Many EGR valves have a substantially linear response over their entire range of opening. To provide accurate control, however, a higher degree of positioning accuracy is required at low flow rates than at high flow rates. Until now, this capability was limited due to the common construction of the EGR valves. As a result, it has been difficult to meter precise small amounts of exhaust gas through the EGR valve.

This is especially difficult for electrically operated EGR valves (EEGR valves) that depend upon linear electrically operated solenoids to open the valve. An example of such a valve is shown in U.S. Pat. No. 5,911,401, which is incorporated herein by reference for all that it teaches.

In the '401 patent, the EEGR valve comprises an elongate valve pintle having a tapered outer surface that is moved by an electrical solenoid towards and away from an annular valve seat. This operation provides a single valve opening with a flow area that varies proportional to the distance the valve pintle moves. As a result, the valve curve has a constant slope, and the valve error and lack of precision is substantially constant over the entire operating range of the valve.

What is needed, therefore, is an improved EGR valve having an improved valve response curve with lower error and higher resolution when the valve is almost closed. It is an object of this invention to provide such an EGR valve.

SUMMARY OF THE PRESENT INVENTION

One embodiment of the invention relates to an EGR valve having an EGR valve body, a valve pintle having a longitudinal axis and supported in the EGR valve body for axially sliding motion relative thereto and having an external substantially outwardly facing first valve sealing surface and a valve shaft extending axially away from the first valve sealing surface, a first valve ring having a substantially inwardly facing first valve seat configured to engage and seal against the first valve sealing surface and having a substantially outwardly facing second valve sealing surface, and a second valve ring fixedly mounted to the EGR valve body and having a substantially inwardly facing second valve seat configured to engage and seal against the second valve sealing surface.

The EGR valve may include an electric solenoid having an armature configured to engage and move the valve pintle in a first direction from a closed position in which the first valve sealing surface is sealed against the first valve seat and the second valve sealing surface is sealed against the second valve seat, to a second position in which the first valve sealing surface is unsealed from the first valve seat and the second valve sealing surface remains sealed against the second valve seat, to a third position in the first direction in which both the first and second valve sealing surfaces are unsealed from the first and second valve seats, respectively.

The average slope of the flow rate versus valve pintle displacement of the EGR valve measured from the closed position to the first position may be less than one-half of the average slope of the flow rate versus valve pintle displacement of the EGR valve measured from the first position to the second position. The diameter of the first valve sealing surface may be less than one-half of the diameter of the second valve sealing surface or less than one-third of the diameter of the second valve sealing surface. The first valve sealing surface and the first valve seat are frusto-conical surfaces may open outward in a direction of valve opening movement. The second valve sealing surface and the second valve seat may be frusto-conical surfaces opening outward in the direction of opening movement.

In accordance with a second embodiment of the invention, an EGR valve for an automotive internal combustion engine includes a valve body, an armature, an electric coil substantially surrounding the armature and configured to drive the armature in a first direction with respect to the valve body, a valve pintle having a longitudinal axis substantially parallel to the first direction, the valve pintle including a valve shaft with a first longitudinal end configured to engage and be driven by the armature, and a second longitudinal end having a frusto-conical first valve sealing surface, a valve ring having a frusto-conical first valve seat configured to sealingly engage the first valve sealing surface and having a frusto-conical second valve sealing surface on an outer surface thereof, anda second valve ring fixedly mounted to the valve body and having a frusto-conical second valve seat configured to sealingly engage the second valve sealing surface. The valve may include a valve ring support slidingly supported on and coaxial with the valve shaft and having a ring supporting surface abutting the valve ring, wherein the ring supporting surface and the frusto-conial first valve sealing surface cooperate to support the valve ring on the end of the pintle. It may also include a spring configured and disposed to press the valve ring support against the valve ring. The spring may be a coil spring surrounding the valve ring and coaxial with the valve shaft. The valve ring support may have a plurality of gas passageways adapted to transmit gas passing between the first valve sealing surface and the first valve seat, or a plurality of legs extending outward.

In accordance with a third embodiment of the invention, a method of operating an EGR valve having a first circular valve sealing surface engageable with a first circular valve seat and a second circular valve sealing surface engageable with a second circular valve seat, wherein the first sealing surface and first valve seat are concentric and have substantially the same first diameter and the second sealing surface and the second valve seat are concentric and have substantially the same second diameter larger than the first diameter, the method comprising the steps of spring tensioning the first valve sealing surface and the first valve seat together in a closed position, spring tensioning the second valve sealing surface and the second valve seat together in the closed position; moving the first valve sealing surface in a first direction away from the first valve seat while holding the first valve seat stationary to create a first annular valve opening between the first valve sealing surface and the second valve seat from the closed position to a first position, simultaneously moving the first valve sealing surface, the first valve seat, and the second valve sealing surface together in the first direction from the first position to a second position while holding the first annular opening constant to create a second annular valve opening between the first valve sealing surface and the second valve sealing surface.

In this method, the step of moving the first valve sealing surface may include the step of providing a first plurality of first sealing surface positions between thee closed position and the first position whereat the area of the first annular valve opening is substantially proportionate to the distance traveled by the first sealing surface. The step of simultaneously moving the first valve sealing surface may include the step of providing a second plurality of second sealing surface positions between the first position and the second position whereat the area of the second annular valve opening is substantially proportionate to the distance traveled by the second sealing surface. The first ratio of change of the area of the second annular valve opening per distance traveled by the second sealing surface between the first and second position may be at least twice as large as a second ratio of change of area of the first annular valve opening per distance traveled by the first sealing surface between the closed position and the first position. It may also be at least three times as large as the second ratio of change. The first valve sealing surface, the first valve seat, the second valve sealing surface and the second valve seat may be substantially circular. The first valve sealing surface, the first valve seat, the second valve sealing surface and the second valve seat may be substantially coaxial. The first valve sealing surface, the first valve seat, the second valve sealing surface and the second valve seat may define planes that are substantially parallel.

Other principal features and advantages of the invention will become apparent to those skilled in the art upon review of the following drawings, the detailed description and the appended claims.

Figure 1:
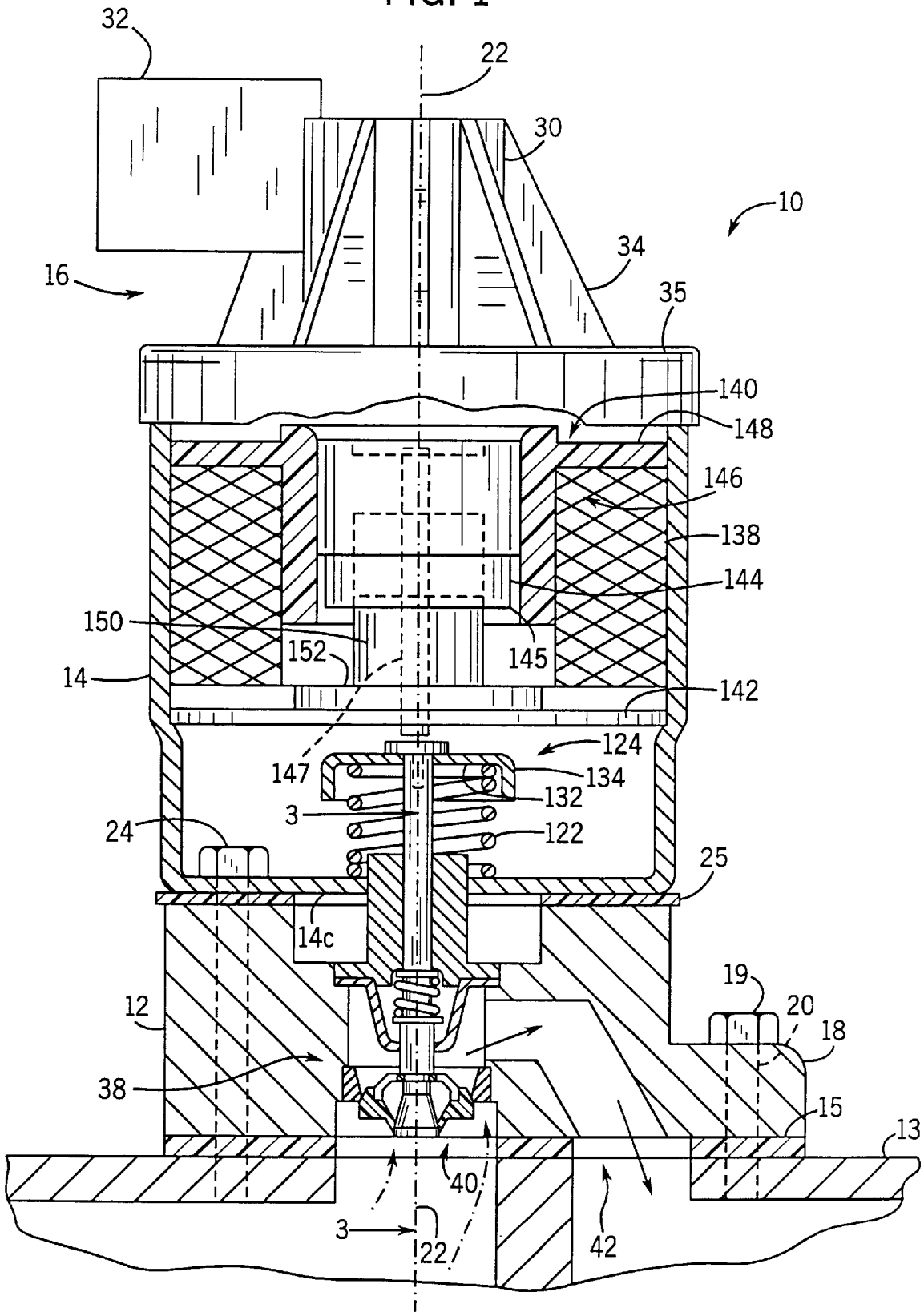
FIG. 1 is a partial cross-sectional view of an EEGR valve made in accordance with the present invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Referring to FIGS. 1–5 which illustrate the arrangement and operation of an electric EGR valve (EEGR valve) 10 embodying the principles of the present invention. EEGR valve 10 comprises a valve body structure composed of a metal base 12, a generally cylindrical metal shell 14 disposed on top of base 12 and a nonmetal cap 16 forming a closure for the otherwise open top of shell 14.

Base 12 comprises a flange 18 having a flat bottom surface adapted to be disposed against a surface of a manifold 13 of an internal combustion engine, typically sandwiching a suitable shaped gasket 15 between itself and the manifold. Flange 18 comprises two through-holes 20 (one shown) that provide for the separable attachment of EEGR valve 10 to an exhaust manifold. The manifold may include a pair of threaded studs which pass through through-holes 20 and onto the free ends of which lock washers are first placed followed by nuts that are threaded onto the studs and tightened for flange 18 toward the manifold, thereby creating a leak proof joint between valve 10 and the manifold. Alternatively, a bolt 19, as shown here, may extend through through-holes 20 and be threaded into manifold 13 to create a similar leak proof joint.

Reference 22 designates a main longitudinal axis of EEGR valve 10. Base 12 further comprises four holes that are parallel to axis 22 and are centered on a common imaginary circle at 90 degree intervals about axis 22. Four fasteners 24 (one shown) fasten base 12 and shell 14 tightly together via the four holes in base 12 and four holes in a bottom wall 14C of shell 14 that register with the four holes in base 12. Each fastener compromises a bolt and a lock washer. Alternatively, a recess or counterbore may be provided on the bottom surface of base 12 into which a nut can be inserted and threaded onto the bolt. A suitable shaped gasket 25 is sandwiched between the base and shell.

Cap 16 is a nonmetallic part, preferably fabricated from suitable polymeric material. In addition to providing a closure for the otherwise open upper end of shell 14, cap 16 comprises a central cylindrical tower 30 and an electric connector shell 32 that projects radially outward from tower 30. Tower 30 has a hollow interior shape to house a position sensor that is utilized for sensing the extent to which EEGR valve 10 is open. Cap 16 further contains several electrical terminals that provide for such a sensor and an electric actuator to be operatively connected with an engine electrical control system. Ends of these terminals are contained within shell 32 to form an electrical connector plug that is adapted to mate with a mating plug (not shown) of an electrical wiring harness of the engine electrical system. Cap 16 also comprises a series of integral triangular shaped walls 34 spaced circumferentially around the cap that provide improved structural rigidity for tower 30 to a bottom wall 35 of the cap with which the tower is integrally formed.

Attention is now directed to details of the internal construction of EEGR valve 10 with continued reference to FIG. 1 and also to a number of subsequent drawing figures showing individual parts in greater detail.

Base 12 comprises an exhaust gas passageway 38 having an entrance 40 coaxial with axis 22 and an exit 42 that is spaced radially outward from entrance 40. Both entrance 40 and exit 42 register with respective passages in the engine exhaust manifold 13.

A valve ring 44, details of which are shown in FIGS. 2–5, is fixed in passageway 38 coaxial with entrance 40 of base 12. Valve ring 44 has an annular shape comprising a through-hole having a frusto-conically tapered surface 46A extending from the top surface of the valve ring to a straight circular cylindrical surface 46B extending to a frusto-conical chamfer 46C at the bottom of the valve ring. The outer perimeter surface of the valve ring comprises a straight circular cylindrical surface 50 that is coaxial with axis 22. Surfaces 46A, 46B, 46C, 50, 60 and 100 are concentric.

Base 12 is constructed with a valve ring mounting hole that has a counterbore providing a shoulder 59 onto which upper surface 60 of valve ring 44 seats. The wedging fit provided by surface 50 being in interference with the wall of entrance 40 below shoulder 59 provides a secure, accurate and gas-tight assembly of the valve ring to the base.

Figure 5:
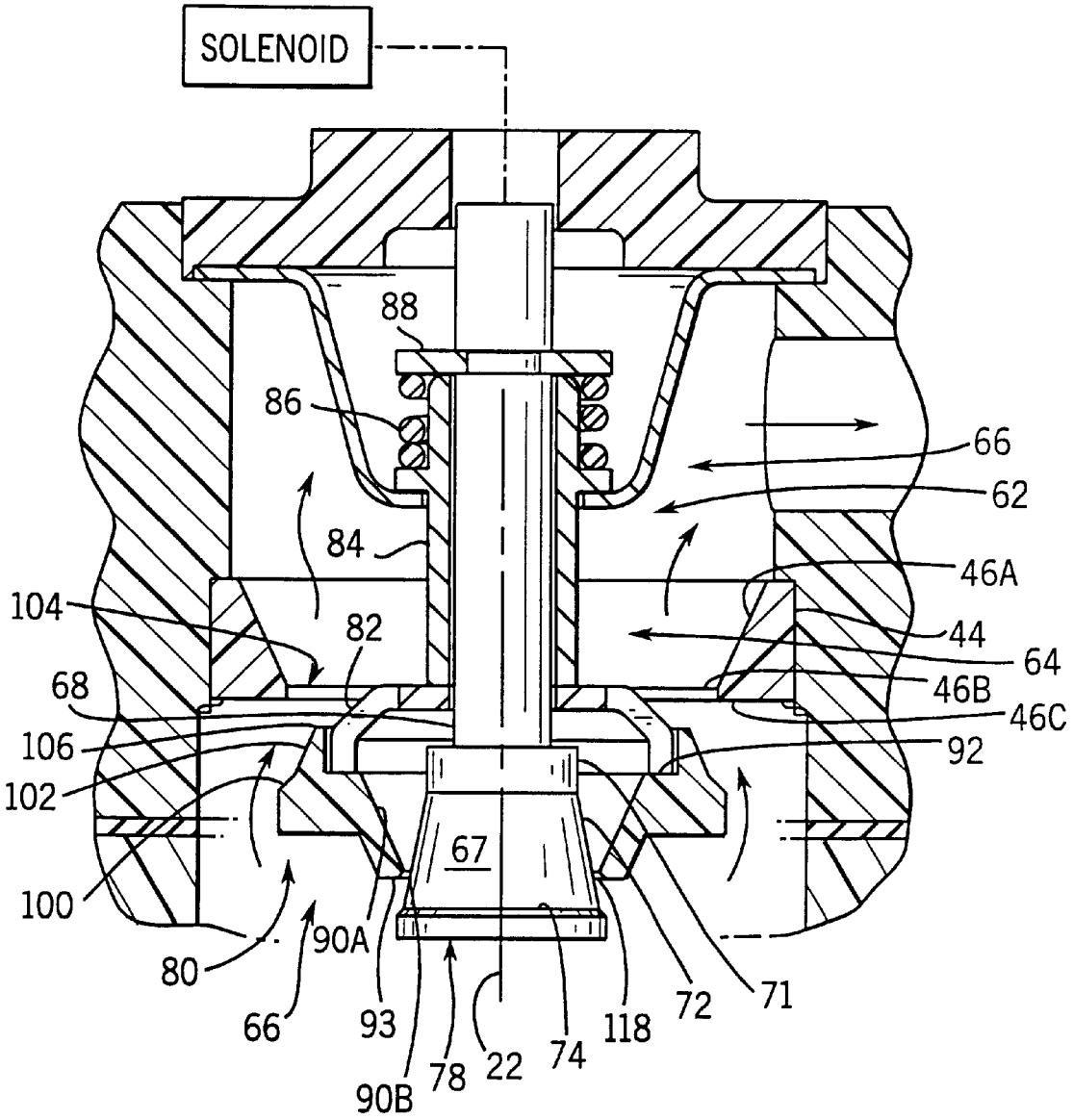

FIG. 5 further shows that EEGR valve 10 comprises a valve pintle assembly 62 that is coaxial with axis 22 and comprises a pintle 64 and a second valve ring assembly 66. Pintle 64 comprises a shaft having a head 67 at the lower end and an internally threaded shaft 68 at the upper end. Head 67 is shaped for cooperation with second valve ring assembly 66 while internally threaded shaft 68 provides for attachment to headed fastener 70. Head 67 has an outer perimeter that is shaped to comprise a straight circular cylindrical surface 71 from the lower edge of which a frusto-conical tapered surface 72 flares radially outwardly to a further frusto-conical tapered surface 74 of larger taper, but shorter axial length, than that of surface 72. The pintle further comprises a flat bottom surface 78 that has a generally circular shape.

Second valve ring assembly 66 includes a second valve ring 80, a valve ring support 82, a collar 84, a spring 86 and a retaining ring 88. Second valve ring 80 has an annular shape comprising a through-hole with a frusto-conically tapered surface 90A extending from a counterbore 92 disposed at the top of ring 80 to a frusto-conical chamfer 90B at the bottom of valve ring 80. Chamfer 90B merges surface 90A and substantially flat annular bottom surface 93. Surface 74 engages surface 90B to prevent the flow of exhaust gas between head 67 and ring 80. When head 67 moves downward with respect to ring 80, an annular gap 118 forms between surfaces 74 and 90B to permit the flow of exhaust gas between head 67 and ring 80.

The outer wall of valve ring 80 includes an upwardly and outwardly extending frusto-conically tapered surface 94 that extends between bottom surface 93 and a substantially flat and circular surface 96. Surface 96 terminates in a right circular cylindrical surface 98. Cylindrical surface 98 extends between surface 96 and an inwardly tapering frusto-conical surface 100. Surface 100 engages chamfer 46C when second valve ring 80 abuts valve ring 44 to prevent the flow of exhaust gas between valve rings 44 and 80. When valve ring 80 is moved downwardly, valve ring 44 and valve ring 80 move apart, creating an annular gap 104 through which exhaust gas passes, as indicated by the gas flow arrows shown in FIG. 5.

Surface 100 merges with inwardly extending frusto-conical surface 102. Surface 102 has a shallower angle, and thus rises more steeply, than surface 100. Surface 102 thereby directs gas passing through gap 104 upward, more parallel to the main longitudinal axis 22 thereby reducing turbulence in gas flowing through the EEGR valve.

Surface 102, in turn merges with substantially flat top surface 106 of valve ring 80.

Valve ring support 82 is in the form of a circular collar 108 extending round the periphery of valve pintle 64 with four outwardly and downwardly extending legs 110. These legs define a plurality of openings 112 through which exhaust gas passes. Legs 110 rest against the bottom of counterbore 92, and serve to center valve ring 80 on pintle 64, as well as move valve ring 80 away from valve ring 44 to create valve gap 104.

While support 82 is shown as formed separately from ring 80, it can be formed integral with ring 80, if desired, since ring 80 and support 82 remain in contact with each other throughout the valve operation process. In addition, while a plurality of legs 110 are shown extending from collar 108, they need not be formed as legs, since the purpose of a gap between each of the legs is merely to provide a gas passageway. Rather than completely separated legs, they can be joined together, as long as sufficient gaps are provided through valve support 82 through which gas can pass. In addition, the number of legs 108 and openings 112 can be varied as long as sufficient gas can pass between valve ring 80 and head 67.

Collar 84 of pintle assembly 62 is in the general form of a right circular cylinder with a flange 114 extending therefrom. Collar 84 is concentric with pintle 64 and is spaced apart from pintle 64 sufficient to permit it to slide on the pintle, yet close enough to pintle 64 to maintain the alignment of valve ring 80 with respect to valve ring 44 and head 67.

The function of flange 114 is to communicate the force of spring 86 to spring support 82 and thence to valve ring 80. Collar 84 has a lower surface that abuts support 82 to push the support downward when collar 84 moves downward. While collar 84 is shown as separate from support 82, it is only made so for convenience. Since collar 84 always moves downward with support 82 and ring 80, these parts can be made integral with one another, if so desired.

Spring 86 abuts the top of collar 84, and applies a downward force to collar 84 when the spring moves downward. The upper end of spring 86 abuts retaining ring 88, which is secured to pintle 64. Spring 86 is a right circular coil spring and is designed to operate in compression. It has a spring constant sufficient to apply force to collar 84, yet not move collar 84, support 82 and ring 80 until retaining ring 88 pushes directly against collar 84 and moves it down.

Figure 2:
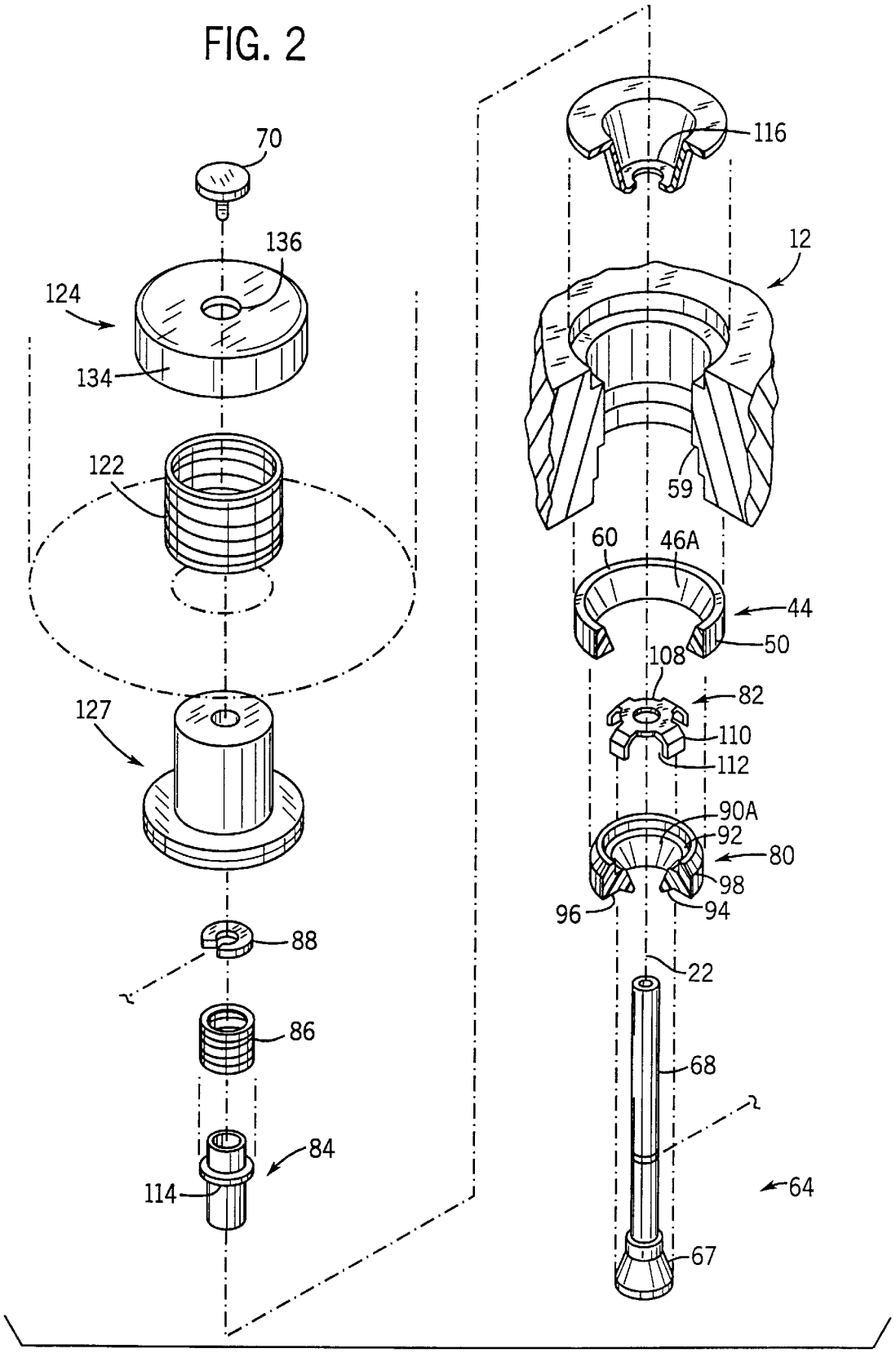
FIG. 2 is an exploded view of the valve pintle and valve seats of the EEGR valve of FIG. 1.
Figure 3:
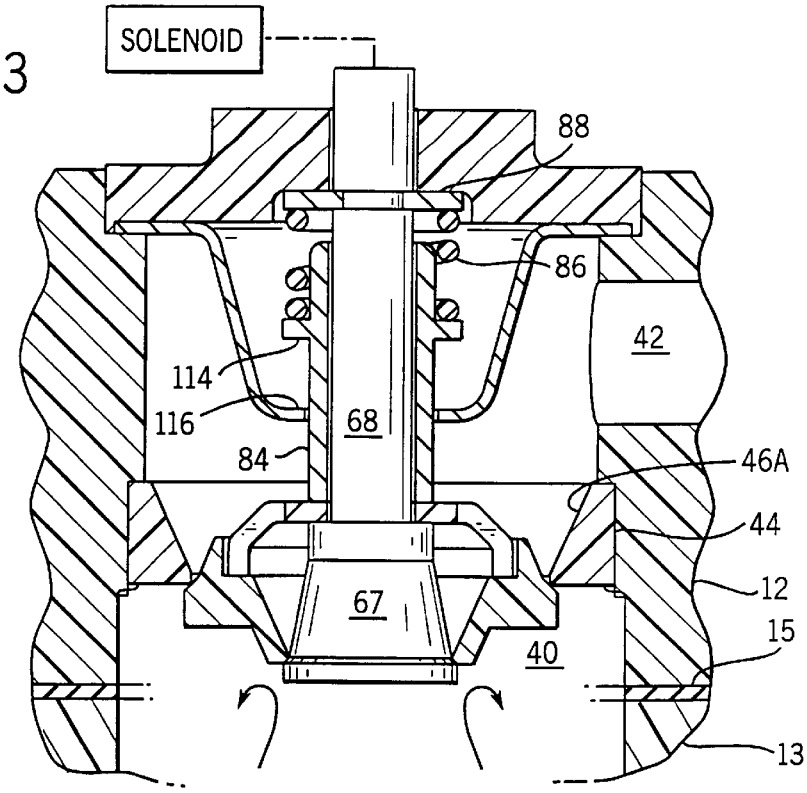
FIGS. 3–5 are partial cross-sectional detailed views of the valve pintle and valve seats of the FIG. 1 valve in three positions: a closed position (FIG. 3) in which no flow is permitted through the valve, a partially open first position (FIG. 4) wherein exhaust gas passes through an annular gap between the valve pintle and a seat on the valve ring, and a completely open third position (FIG. 5) in which exhaust gas passes between the valve pintle and the valve ring as in FIG. 4, and also between the valve ring and a valve seat mounted to the valve body.

Referring to FIGS. 1 and 2, a pintle support and return assembly 120 is provided to close the EEGR valve. This assembly includes spring 122, spring retainer 124, screw 70 and bearing 127.

Spring 122 is a coil spring disposed inside metal shell 14 and has a spring constant sufficient to pull pintle 64 far enough to close the EEGR valve. Its function is to hold the valve closed. It has a lower end that abuts bottom wall 14*c* of shell 14, and an upper end 130 that abuts spring retainer 124. The upward force of spring 122 on pintle 64 pulls the pintle up and the valve closed.

Spring retainer 124 is in the form of an inverted cup, and has an inside and downwardly facing planar surface 132 against which upper end 130 abuts. Its function is to communicate the spring force of spring 124 to pintle 64. A short downwardly extending rim 134 is provided at an outer edge of retainer 124 to prevent spring 122 from sliding off retainer 124 yet spaced sufficiently far from spring 122 to permit some lateral movement of the spring. A hole 136 is provided in the center of planar surface 132 to attach retainer 124 to pintle 64.

If, during operation or assembly, spring 122 is tilted or moves off center, it may apply side-to-side forces against retainer 124 in addition to the desired upward forces that hold the valve closed. In response to this, the retainer can move slightly to the side until the lateral forces are relieved. To permit retainer 124 to move slightly side-to-side, hole 136 is made slightly larger than the upper end of pintle 64 which is inserted through the hole. Lateral or bending forces applied to pintle 64 may cause the pintle to be cocked in bearing 127 causing undue bearing wear.

Screw 70 is provided to attach retainer 124 to the upper end of pintle 64. The head of screw 70 is sized large enough to prevent it from being pulled through hole 136.

Bearing 127 supports pintle 64 and holds it in alignment with respect to valve ring 44. Bearing 127 has an inner diameter large enough to permit pintle 64 to slide up and down inside the valve base when pushed by the solenoid, yet small enough to reduce exhaust gas leakage upward into metal shell 14 and to keep valve ring 80 properly aligned with valve ring 44.

A solenoid is provided to open and close the valve. The solenoid includes an electrical coil 138, upper stator 140, lower stator 142 and armature 144.

Coil 138 is toroidal with a rectangular cross-section. The longitudinal axis of the coil is colinear with main longitudinal axis 22 of the valve.

Upper stator 140 includes a right circular cylinder 146 that extends inside and coaxial with the coil. It is coupled to a substantially flat flange 148 that extends outward from cylinder 146 across the top of the coil and has an outer edge that extends proximate to metal shell 14.

The lower stator is similarly comprised of a right circular cylinder 150 that extends inside and is coaxial with the coil. It also includes a substantially flat flange 152 that extends from cylinder 150 proximate to metal shell 14.

Armature 144 has a circular cylinder 145 disposed inside upper stator cylinder 150, and a recess at its bottom to receive lower stator cylinder 150. Armature 144 also includes a metal shaft 147 which is coaxial with and fixed to cylinder 145.

The valve operates in the following manner. Coil 138 is electrically coupled to the contacts (not shown) in electrical connector housing 32 to receive outside power. This outside power, when applied, sends a current through coil 138.

This current generates a magnetic field that causes armature 144, and hence shaft 147 to move downward toward pintle 64. Ultimately, the current is large enough that shaft 147 contacts pintle 64, pushes it down and opens the valve.

The valve moves from its initial closed position first by creating an annular gap 118 between head 67 and valve ring 80. As armature 144 moves downward with increasing valve current, it contact the upper end of pintle 64. As armature 144 keeps moving downward from this initial contact position, it moves pintle 64 downward, compressing spring 122. When pintle 64 moves downward, head 67 moves downward away from ring 80, which remains stationary. This creates annular gap 118 between head 67 and ring 80 through which exhaust gas first begins to flow.

The change in width of annular gap 118 is substantially proportional to changes in the current flowing through coil 138. While the coil, stator and armature may be spaced apart or shaped in a variety of different manners to form a variety of different current versus valve opening curves, the more current that flows through the coil, the more the valve opens.

Figure 4:
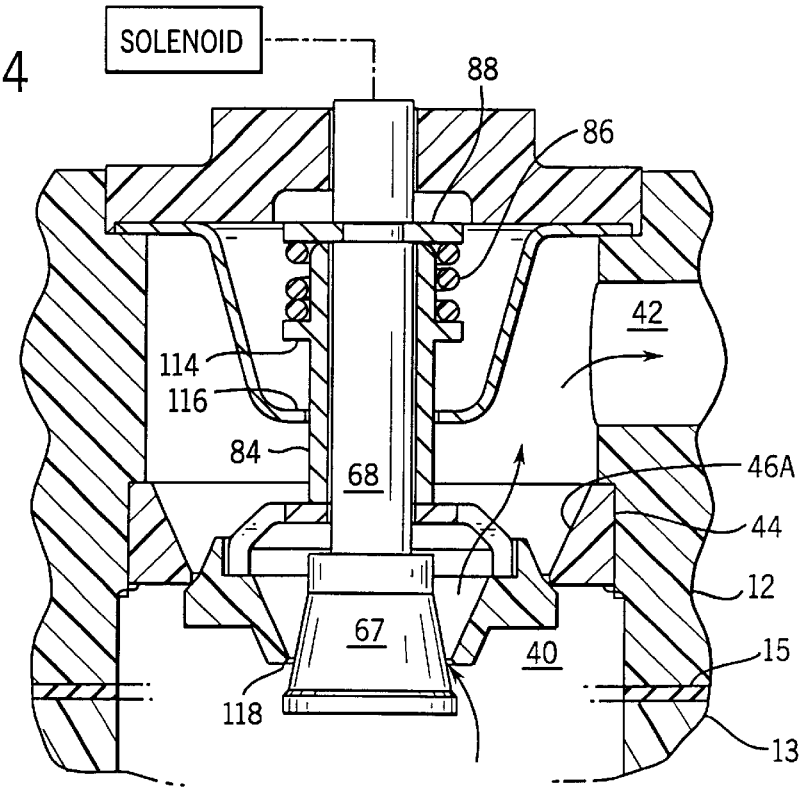

The valve continues to operate by moving head 67 away from ring 80 until retaining ring 88 abuts collar 84. At this point, which is the second position and is shown in FIG. 4, retaining ring abuts collar 84, collar 84 abuts valve support 82, and valve support 82 abuts ring 80. As current subsequently increases and pintle 64 continues moving downward, ring 80 and head 67 move downward together. Annular gap 118 is now as large as it can get.

Downward motion of head 67 and ring 80 begin to create the second annular gap 104 between ring 80 and ring 44. Each incremental downward pintle movement serves to incrementally increase this second annular gap. This, in turn, permits exhaust gas to flow not only through first annular gap 118 (now a constant size regardless of further pintle motion), but through gradually increasing annular gap 104. There are now two concentric coaxial annular flow channels to permit the passage of exhaust gas through the valves.

Figure 6:
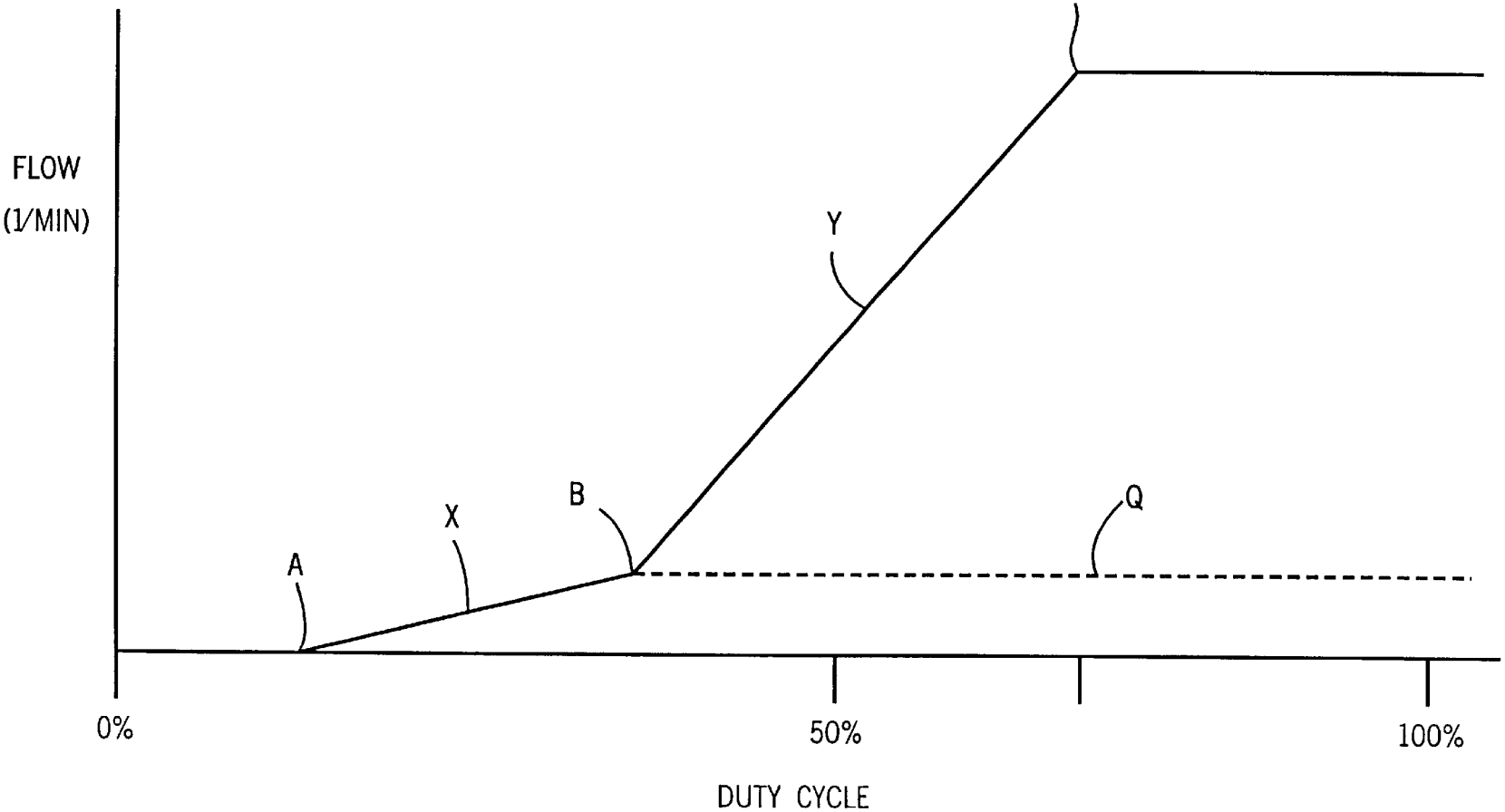
FIG. 6 shows a valve response curve of the valve of FIGS. 1–5 comparing the duty cycle of the solenoid actuator (i.e. the displacement of the valve pintle) versus the flow rate through the EEGR valve itself.

By providing two flow channels, gaps 104 and 118, the EEGR valve provides a non-linear flow regime best shown in FIG. 6. FIG. 6 illustrates the response of the valve versus the signal applied to the valve coil over its entire operating range.

From point A to point B, the first annular gap 118 (between pintle head 67 and ring 80) gradually increases with increasing valve current at a first rate indicated by the slope of line segment X. This slope is substantially constant over the range of annular gap 118 opening. Point A indicates the percent duty cycle of the PWM signal applied to coil 138 at which the armature first touches pintle 64. Each succeeding increment of current (e.g., duty cycle increase) causes pintle 64 to first begin to move and open the valve. Point B is the point at which the first annular gap 118 created between head 67 and ring 80 is open to its fullest extent and any additional pintle movement will begin to open annular gap 104. This position is shown in FIG. 4.

From point B to point C, the first annular gap is fixed, and thus passes a constant amount of exhaust gas regardless of the signal applied to the coil. This is indicated by dashed line Q. Nonetheless, the flow through the valve increases from point B to point C since the second annular gap 104 (between ring 80 and ring 44) gradually increases with increasing valve current at a second rate indicated by the slope of line segment Y (see FIG. 6). This line segment of the valve response curve, like segment X, is substantially linear and has a substantially constant slope.

The slope of line segment Y is preferably at least twice as great as the slope of line segment X. By providing a valve opening curve with significantly different slopes, the accuracy of the EEGR at low flow rates can be more accurately controlled. By making the slope of the valve curve smaller at low exhaust gas volumetric flow rates, the exhaust gas flow rate error, which is a product of the valve resolution and the slope of the valve curve, is correspondingly reduced. This low speed accuracy is of special importance for cars used in polluted urban areas. It is in these areas of high pollution that cars spend a great deal of time at or near idle, waiting at traffic lights and intersections. At engine idle, the EEGR valve is typically operating in the low flow rate (point A to point B) portion of the curve.

The difference in slope is provided by having successively opening annular gaps, one gap being substantially larger than the other. In the embodiment shown here, the diameter of gap 118 (i.e., the diameter of the mutually contacting surfaces of head 67 and ring 80) is less than one-half the diameter of gap 104 (i.e., the diameter of the mutually contacting surfaces of ring 80 and ring 44). If a more precise control at low flow rates is required, the ratio of gap 118 diameter to gap 104 diameter can be reduced to less than one-third. In addition, changing the conical angle of the mating valve surfaces can also influence the relative flow rates of the two annular gaps.

Thus, it should be apparent that there has been provided in accordance with the present invention a double action single valve EEGR that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An EGR valve for an automotive internal combustion engine comprising:

a valve body;

an armature;

an electric coil substantially surrounding the armature and configured to drive the armature in a first direction with respect to the valve body;

a valve pintle having a longitudinal axis substantially parallel to the first direction, the valve pintle including a valve shaft with a first longitudinal end configured to engage and be driven by armature, and a second longitudinal end having a frusto-conical first valve sealing surface;

a valve ring having a frusto-conical first valve seat configured to sealingly engage the first valve sealing surface and having a frusto-conical second valve sealing surface on an outer surface thereof;

a second valve ring fixedly mounted to the valve body and having a frusto-conical second valve seat configured to sealingly engage the second valve sealing surface; and, a valve ring support slidingly supported on and coaxial with the valve shaft and having a ring supporting surface abutting the valve ring, wherein the ring supporting surface and the frusto-conical first valve sealing surface cooperate to support the valve ring on the end of the pintle.

2. The EGR valve of claim 1, further comprising a spring configured and disposed to press the valve ring support against the valve ring.

3. The EGR valve of claim 2, wherein the spring is a coil spring surrounding the valve ring and coaxial with the valve shaft.

4. The EGR valve of claim 3, wherein the valve ring support has a plurality of gas passageways adapted to transmit gas passing between the first valve sealing surface and the first valve seat.

5. The EGR valve of claim 4, wherein the valve ring support has a plurality of legs extending outward.

6. A method of operating an EGR valve having a first circular valve sealing surface engageable with a first circular valve seat and a second circular valve sealing surface engageable with a second circular valve seat, wherein the first sealing surface and first valve seat are concentric and have substantially the same first diameter and the second sealing surface and the second valve seat are concentric and have substantially the same second diameter larger than the first diameter, the method comprising the steps of:

spring tensioning the first valve sealing surface and the first valve seat together in a closed position;

spring tensioning the second valve sealing surface and the second valve seat together in the closed position;

moving the first valve sealing surface in a first direction away from the first valve seat while holding the first valve seat stationary to create a first annular valve opening between the first valve sealing surface and the second valve seat from the closed position to a first position;

simultaneously moving the first valve sealing surface, the first valve seat, and the second valve sealing surface together in the first direction from the first position to a second position while holding the first annular opening constant to create a second annular valve opening between the first valve sealing surface and the second valve sealing surface.

7. The method of claim 6 wherein the step of moving the first valve sealing surface includes the step of:

providing a first plurality of first sealing surface positions between thee closed position and the first position whereat the area of the first annular valve opening is substantially proportionate to the distance traveled by the first sealing surface.

8. The method of claim 7, wherein the step of simultaneously moving the first valve sealing surface includes the step of:

providing a second plurality of second sealing surface positions between the first position and the second position whereat the area of the second annular valve opening is substantially proportionate to the distance traveled by the second sealing surface.

9. The method of claim 8, wherein a first ratio of change of the area of the second annular valve opening per distance traveled by the second sealing surface between the first and second position is at least twice as large as a second ratio of change of area of the first annular valve opening per distance traveled by the first sealing surface between the closed position and the first position.

10. The method of claim 9, wherein the first ratio of change is at least three times as large as the second ratio of change.

11. The method of claim 10, wherein the first valve sealing surface, the first valve seat, the second valve sealing surface and the second valve seat are substantially circular.

12. The method of claim 11, wherein the first valve sealing surface, the first valve seat, the second valve sealing surface and the second valve seat are substantially coaxial.

13. The method of claim 12, wherein the first valve sealing surface, the first valve seat, the second valve sealing surface and the second valve seat are substantially parallel.

* * * * *